US005631433A

United States Patent [19]

Iida et al.

[11] Patent Number: 5,631,433

[45] Date of Patent: May 20, 1997

[54] KARAOKE MONITOR EXCLUDING UNNECESSARY INFORMATION FROM DISPLAY DURING PLAY TIME

[75] Inventors: Toshiya Iida; Hirokazu Kato, both of Hamamatsu, Japan

[73] Assignee: Yamaha Corporation, Hamamatsu, Japan

[21] Appl. No.: 553,887

[22] Filed: Nov. 6, 1995

[30] Foreign Application Priority Data

Nov. 8, 1994 [JP] Japan ..... 6-273388

[51] Int. Cl.[6] ..... G10H 1/36

[52] U.S. Cl. ..... 84/610; 84/634; 434/307 A

[58] Field of Search ..... 84/609, 610, 611, 84/612, 613, 614, 634, 635, 636, 477 R, DIG. 6; 348/705, 706; 434/307 A

[56] References Cited

U.S. PATENT DOCUMENTS 5,496,178 3/1996 Back ..... 434/307 A 5,506,690 4/1996 Kim ..... 358/342

5,557,675 9/1996 Schupak ..... 380/10

5,565,929 10/1996 Tanaka ..... 348/565

*Primary Examiner*—William M. Shoop, Jr.

*Assistant Examiner*—Marlon Fletcher

*Attorney, Agent, or Firm*—Loeb & Loeb LLP

[57] ABSTRACT

A karaoke apparatus sounds a karaoke accompaniment and displays visual information to perform karaoke play. An audio generator responds to a request for generating an audio signal. A sound component is switchable from an inactive state to an active state for receiving the audio signal to sound a karaoke accompaniment corresponding to the request. A video generator having a plurality of channels generates a plurality of video signals which represent visual information containing various items assigned differently to the representative channels. A channel selector switches the channels to select an adequate video signal so as to control the visual information. A monitor receives the selected video signal for displaying the visual information such that the displayed visual information includes a necessary item and excludes an unnecessary item for the karaoke play at least under the active state of the sound component.

5 Claims, 6 Drawing Sheets

| | | |
|---|---|---|
| Header | Accompaniment track | Voice data part |
| | Lyric word track | |
| | Vocal track | |
| | DSP Control track | |

FIG.4A

Play register

| Song code | Play time | Lapse time |
|---|---|---|

FIG.4B

Reservation table

| | | |
|---|---|---|
| First entry | Song code | Play time |
| Second entry | Song code | Play time |
| Third entry | Song code | Play time |
| Fourth entry | Song code | Play time |
| Fifth entry | Song code | Play time |

FIG.5

Reservation list

| | | |
|---|---|---|
| First number | [Song title 1] | 01 : 35 |
| Second number | [Song title 2] | 04 : 50 |
| Third number | [Song title 3] | 09 : 27 |
| Fourth number | [Song title 4] | 13 : 03 |
| Fifth number | [Song title 5] | 17 : 25 |

KARAOKE MONITOR EXCLUDING UNNECESSARY INFORMATION FROM DISPLAY DURING PLAY TIME

BACKGROUND OF THE INVENTION

The present invention relates to a karaoke apparatus having a monitor which displays visual information including a service item which prescribes an entry order and the like in addition to regular items of lyric words, background pictures and so on during play time of karaoke performance. More specifically, the present invention relates to improvements in display control of the monitor.

A popular karaoke apparatus is provided with a monitor which displays lyric words and ba&ground pictures during karaoke performance. Another karaoke apparatus developed for public commercial use is provided with a monitor placed before a play member who sings a karaoke song and another monitor placed before audience members other than the play member. A further karaoke apparatus is developed such that the monitor can display a list of reserved songs in addition to the lyric words and the background pictures. In the karaoke apparatus having two monitors, generally a first monitor before the play member has a size smaller than that of a second monitor before the audience members. In such a case, the first monitor displays service information such as the list of the reserved songs additionally to the lyric words within a limited screen during the karaoke performance. The play member cannot clearly view the lyric words to thereby hinder smooth singing performance. Stated otherwise, the service information is not necessary or wanted for the play member. On the other hand, the same service information is necessary and wanted for the audience member who waits for his or her turn and who wishes to know his or her order and waiting time.

SUMMARY OF THE INVENTION

An object of the present invention is to provide a karaoke apparatus constructed to display service information such as waiting time and to temporarily exclude the same service information when it becomes unnecessary for karaoke performance from a monitor placed before a player.

The inventive karaoke apparatus sounds a karaoke accompaniment and displays visual information to perform karaoke play. The apparatus comprises an audio generating device responsive to a request for generating an audio signal, a sound device switchable from an inactive state to an active state for receiving the audio signal to sound a karaoke accompaniment corresponding to the request, a video generating device that has a plurality of channels for generating a plurality of video signals which represent visual information containing various items assigned differently to the respective channels, a channel selector device that switches the channels to select an adequate video signal so as to control the visual information, and a monitor receptive of the selected video signal for displaying the visual information such that the displayed visual information includes a necessary item and excludes an unnecessary item for the karaoke play at least under the active state of the sound device.

The inventive karaoke apparatus has the plurality of the channels for providing the different video signals. One of the video signals is selectively applied to the monitor such that the unnecessary item of the visual information is excluded from the display in the play time. The switching of the channels may be effected dependently on the active and inactive states of the sound device, or otherwise may be conducted during the course of the karaoke accompaniment. Further, the channel is switched manually by inputting a command, or otherwise switched automatically.

BRIEF DESCRIPTION OF DRAWINGS

FIGS. 4A and 4B are schematic diagrams showing a register and a table formed in a RAM contained in the inventive karaoke apparatus.

FIG. 5 is an illustrative diagram showing exemplified display of waiting time in the inventive karaoke apparatus.

DETAILED DESCRIPTION OF THE INVENTION

Figure 1:
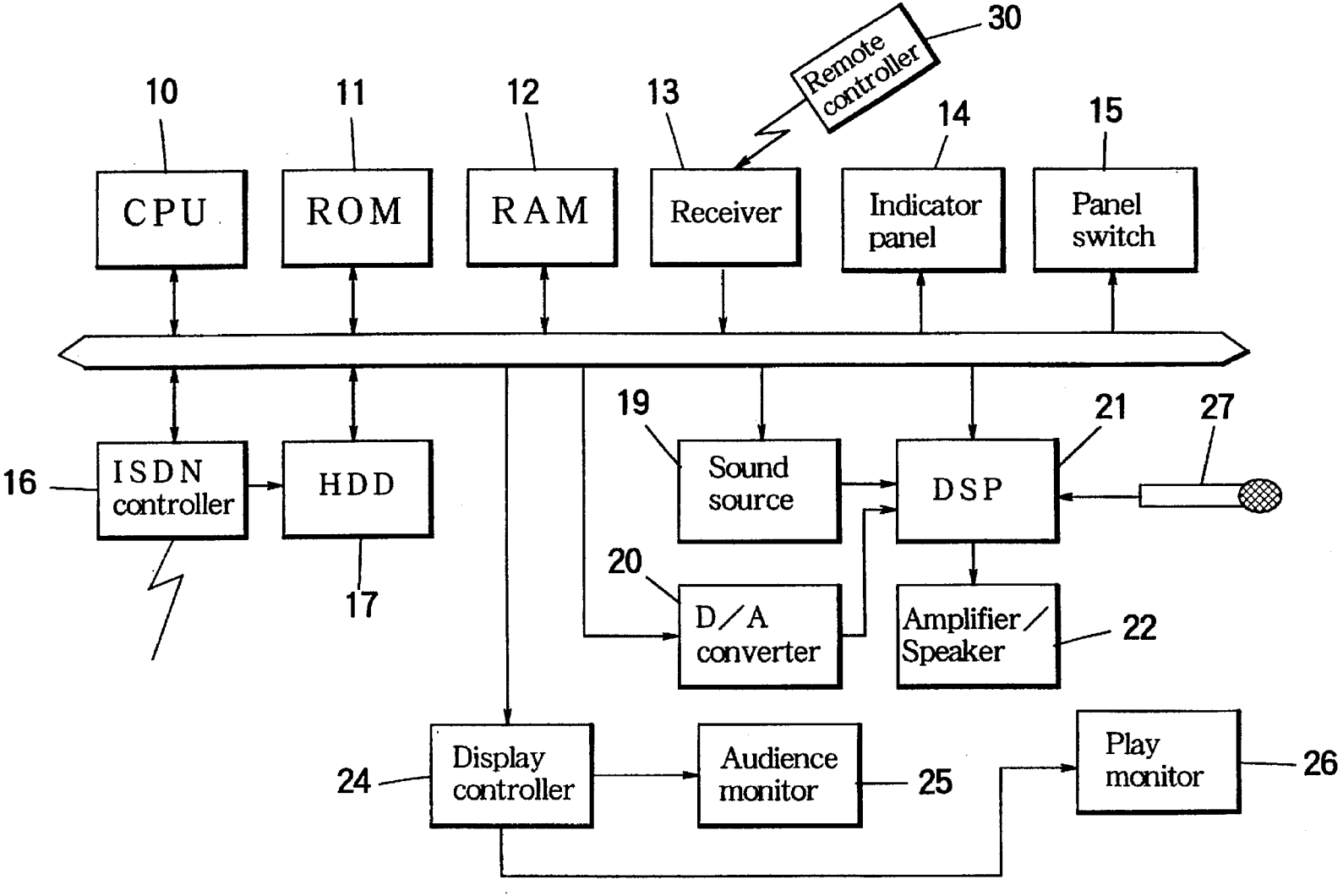
FIG. 1 is a block diagram showing one embodiment of the inventive karaoke apparatus.

FIG. 1 is a block diagram showing one embodiment of the inventive karaoke apparatus. The karaoke apparatus is provided with a pair of monitors. One is a play monitor 26 of a small or compact size disposed on a stage where a player sings a song along karaoke accompaniment while handling a microphone 27. The other is an audience monitor 25 of a large size installed in front of audience. During the course of the karaoke performance, both of the monitors 25 and 26 display background pictures and lyric words. During other than the course of the karaoke performance, both of the monitors 25 and 26 display service information such as a list of reserved entry songs. Further, in case that the service information is updated incidentally during the course of the karaoke performance, the updated service information is displayed only on the audience monitor 25 in superimpose manner to the background picture, while the same service information is excluded from the display of the play monitor 26 so that the play monitor 26 displays only the background pictures and the lyric words.

This karaoke apparatus is a communication type sound source karaoke apparatus. The sound source karaoke apparatus stores song data containing accompaniment data and voice data for actuating an internal sound source 19 mid a D/A converter 20. The sound source 19 generates karaoke accompaniment sound by sequentially reading out the accompaniment data. The D/A converter 20 generates back chorus sound or the like according to the voice data. Further, the communication type karaoke apparatus means that the karaoke apparatus is connected to a host station through a communication line such as ISDN line to download the song data including the accompaniment data from the host station. The karaoke apparatus has a hard disk drive (HDD) 17 capable of storing song data representative of hundreds to thousands of karaoke songs so that the downloaded song data can be stored in the HDD. The karaoke apparatus can input a request command for selection of the stored songs by a manual commander such as an infrared remote controller 30 and a panel switch 15. The request command can select or designate a plurality of entry songs at once. The requested songs are reserved and registered in a reservation table in the entry order of old ones to new ones.

In detail, a CPU 10 controls entire operation of the karaoke apparatus. The CPU 10 is connected through a bus to a ROM 11, a RAM 12, a hard disk drive (HDD) 17, an ISDN controller 16, a remote control receiver 13, an indicator panel 14, a panel switch 15, a sound source 19, a D/A converter 20, a digital signal processor (DSP) 21, and a display controller 24.

The ROM 11 stores a system program, a sequence program, a loader program and font data. The system program controls basic operation and data send/receive operation associated with peripherals. The sequence program contains a main sequence program, an accompaniment sequence program, a character sequence program, a vocal sequence program and a DSP sequence program. At the time of karaoke performance, the respective sequence programs are executed in parallel by the CPU 10 to replay audio and video parts of karaoke performance based upon the song data. The loader program is used for downloading the song data from the host station. The font data represent plural kinds of character fonts like a Mincho typeface and a round-bold typeface such that the lyric words or title of the song can be displayed by using the font data. The RAM 12 provides a work area therein for the CPU 10 and a reservation table, while the HDD 17 stores a song data file of hundreds to thousands of karaoke songs. The ISDN controller 16 is used to communicate with the host station through the ISDN line so that the song data or other data can be downloaded from the host station. The ISDN controller 16 contains a DMA circuit to write the downloaded song data directly into the HDD 17, not via the CPU 10.

The remote control receiver 13 receives an infrared signal sent from a remote controller 30, and restores a request command and other commands. The remote controller 30 sends the request command for music selection and the like. The remote controller 30 is provided with key switches including a command switch for music selection and for music reservation, and ten-key switches. Therefore, when a user operates these switches, the request command in the form of a song code is generated as an infrared signal in response to the user's operation. The indicator panel 14 is provided on the front side of the karaoke apparatus to indicate, for example, the admitted song code currently on process and the total number of booked or reserved songs. The panel switch 15 is also provided on the front side of the karaoke apparatus, including a song code input switch and a tone key changing switch.

The sound source 19 receives the sequential accompaniment data contained in the song data to generate an audio tone signal. The D/A converter 20 receives the voice data contained in the same song data to convert the voice data into an audio voice signal. The voice data is formed of ADPCM data which is converted into the analog audio voice signal representative of a back chorus or the like. The microphone 27 is connected to the DSP 21 to collect a singing voice signal originating from a karaoke player. The DSP 21 imparts sound effects such as reverb and echo to those of the audio tone signal fed from the sound source 19, the audio voice signal fed from the D/A converter 20 and the singing voice signal fed from the microphone 27. The type and degree of the effects imparted by the DSP 21 are controlled based upon DSP control data contained in the song data. The DSP control data are taken from the composite song data by the CPU 10, and are fed to the DSP 21. The tone signal and the voice signals to which the sound effects are applied are mixed together and outputted to an amplifier/speaker 22. The amplifier/speaker 22 amplifies and sounds the mixed audio signal.

Figures 2, 3:
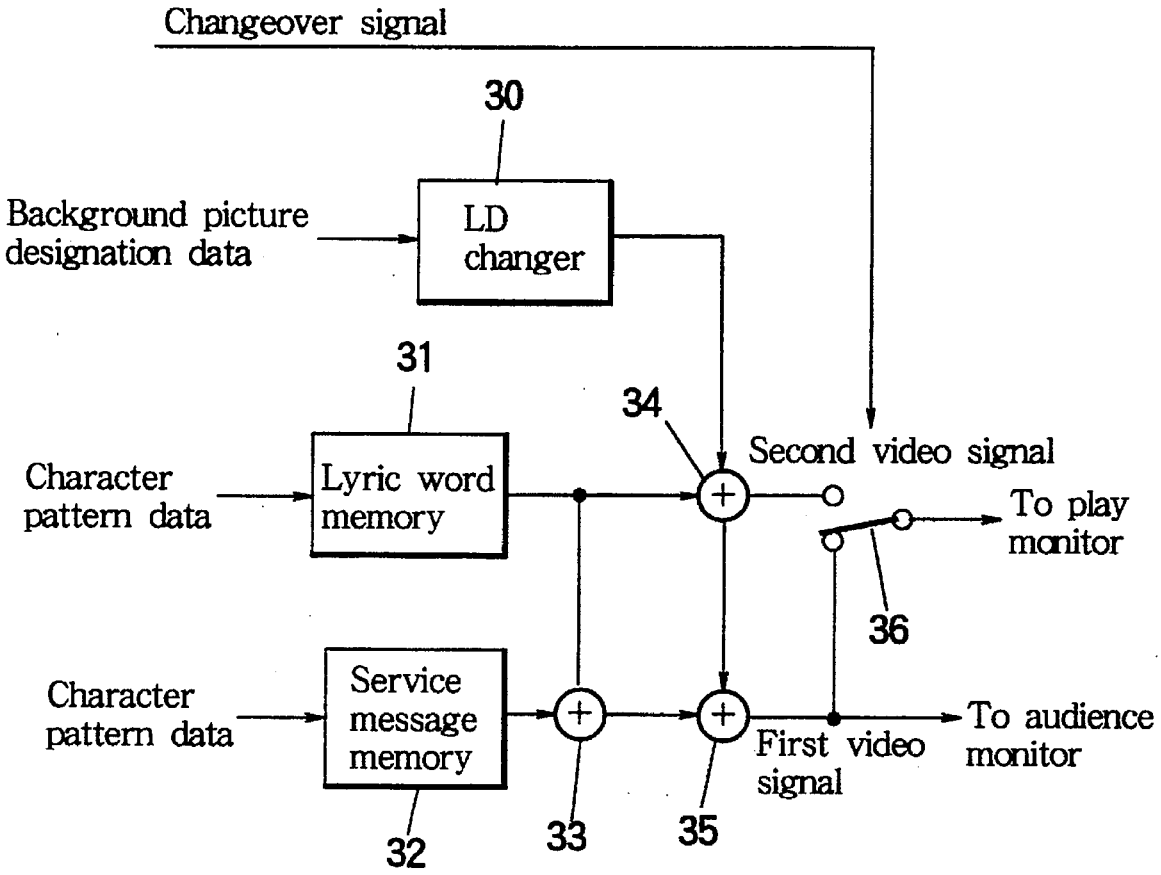
FIG. 2 is a structural diagram showing a display controller provided in the inventive karaoke apparatus.
FIG. 3 is a schematic diagram showing a format of song data.

The display controller 24 is connected to the play monitor 26 disposed before a play member who sings a song along the sounded karaoke accompaniment, and is also connected to the additional audience monitor 25 disposed before audience members who wait for their turn. The display controller 24 feeds a video signal representative of visual information containing a background picture item and a lyric word item of the karaoke song to both of the play monitor 26 and the audience monitor 25. FIG. 2 is a block diagram showing a detailed construction of the display controller 24. The display controller 24 receives from the CPU 10 background picture designation data for designating a background picture to be reproduced, first character pattern data representative of lyric words, and second character pattern data representative of service message. The background picture designation data are inputted into a Laser Disc (LD) changer 30. The first character pattern data are stored in a lyric word memory 31. The second character pattern data are stored in a service message memory 32. The LD changer 30 contains about five number of LDs, and operates based on the background picture designation data fed from the CPU 10 to select one LD and to designate one chapter of the selected LD for reproducing background pictures in matching with the performed karaoke song.

The lyric word memory 31 feeds the stored character pattern data to an adder 33 and another adder 34. The adder 33 adds this character pattern data representative of the lyric words to the other character pattern data representative of the service message provided from the service message memory 32. The added character pattern data are inputted into a further adder 35. Moreover, background picture data reproduced from the LD changer 30 are fed to the adder 34 and to the further adder 35 which is connected to the preceding adder 33. Thus, the succeeding adder 35 constitutes a first channel which generates a first video signal representative of visual information containing three items of the background picture, the lyric words and the service message which are superimposed over the background picture. On the other hand, the adder 34 constitutes a second channel which generates a second video signal representative of visual information including two items of the background picture and the lyric words superimposed over the background picture, but excluding the service message. Namely, the first and second channels generate different versions of the visual information in the form of the first and second video signals containing different items.

The first video signal is fed to the audience monitor 25 and to a channel selector in the form of a select switch 36. The second audio signal is fed from the adder 34 to the select switch 36. The select switch 36 has an output terminal connected to the play monitor 26. The select switch 36 is operated in response to a changeover signal inputted from the CPU 10. Normally, the select switch 36 is controlled to select the first video signal. However, when the service item such as a reservation list is called and displayed during the course of karaoke performance in which the sound source is placed in an active state to sound the karaoke accompaniment, the select switch 36 is switched to select the second video signal which is fed to the play monitor 26. Consequently, the play monitor 26 displays the visual information including necessary items of the background picture and the lyric words which are essential to the karaoke play, but excluding an unnecessary item of the service message which is not essential to the karaoke play.

FIG. 3 is a schematic diagram showing a format of the composite song data. The song data of one karaoke song contains a header, an accompaniment track, a lyric word track, a vocal track, a DSP control track, and a voice data part. The header contains various reference data of the karaoke song such as song title, genre, release date and play time. When a karaoke song is requested for entry or reservation, the CPU 10 reads out the play time from the header of the requested song data, and registers the read play time in the reservation table. Further, when the karaoke performance is started, the CPU 10 determines a kind of background pictures in matching with the performed karaoke song based on the genre prescribed in the header to thereby feed the background picture designation data to the LD changer 30. The background picture may be determined such that a snow fall scene may be adopted for a Japanese ballad associative of winter season, or a western country scene may be adopted for pops.

The accompaniment track is divided into subtracks of various parts including a melody subtrack and a rhythm subtrack. Each subtrack is written with sequence data composed of event data and duration data. The CPU 10 operates based on the sequence program to count the duration data. Upon counting up of the duration, the CPU 10 reads out event data subsequent to the counted duration data so as to generate the audio tone signal. The lyric word track prescribes lyric words which are displayed on the monitors 25 and 26. The lyric word data is not musical tone data, but the lyric word track is formed according to MIDI format in the form of system exclusive message in order to integrate system implementation and in order to facilitate song data assembling. The vocal track prescribes sequence data for generating an audio voice signal such as back chorus and harmony melody which could not be well synthesized by the sound source 19. The voice data contained in the composite song data are sequentially read out according to event data of the vocal track so as to generate the audio voice signal. The voice data is provided in the form of ADPCM data which is prepared by sampling a live voice. The voice data is divided a phrase by phrase basis. The DSP control track prescribes sequence data for controlling the DSP 21. The DSP 21 imparts various effects such as reverberation to the musical sound. The DSP 21 regulates time-dependent variation of the effects based on effect kind data and variation depth data recorded in the DSP control track.

FIGS. 4A and 4B show an internal structure of the RAM 12. As shown in the figures, the RAM 12 is set with a play register and a reservation table. The play register memorizes a song code of the currently performed karaoke song, the total play time of the same, and a lapse time which indicates how far the karaoke play progresses. The reservation table records song codes of the currently reserved entry karaoke songs and their total play times in the order of the entry. The reservation table can register more or less ten numbers of entry karaoke songs.

FIG. 5 shows an example of the reservation list displayed on the monitor. The reservation list is displayed when a list call command is inputted by the remote controller 30. The reservation list indicates an order of each entry number, i.e., each reserved song, each song title and a wait time until each song is started. As described before, when the list call command is inputted during the course of the karaoke play, the reservation list is displayed only on the audience monitor 25, and is excluded from the play monitor 26.

Figure 6:
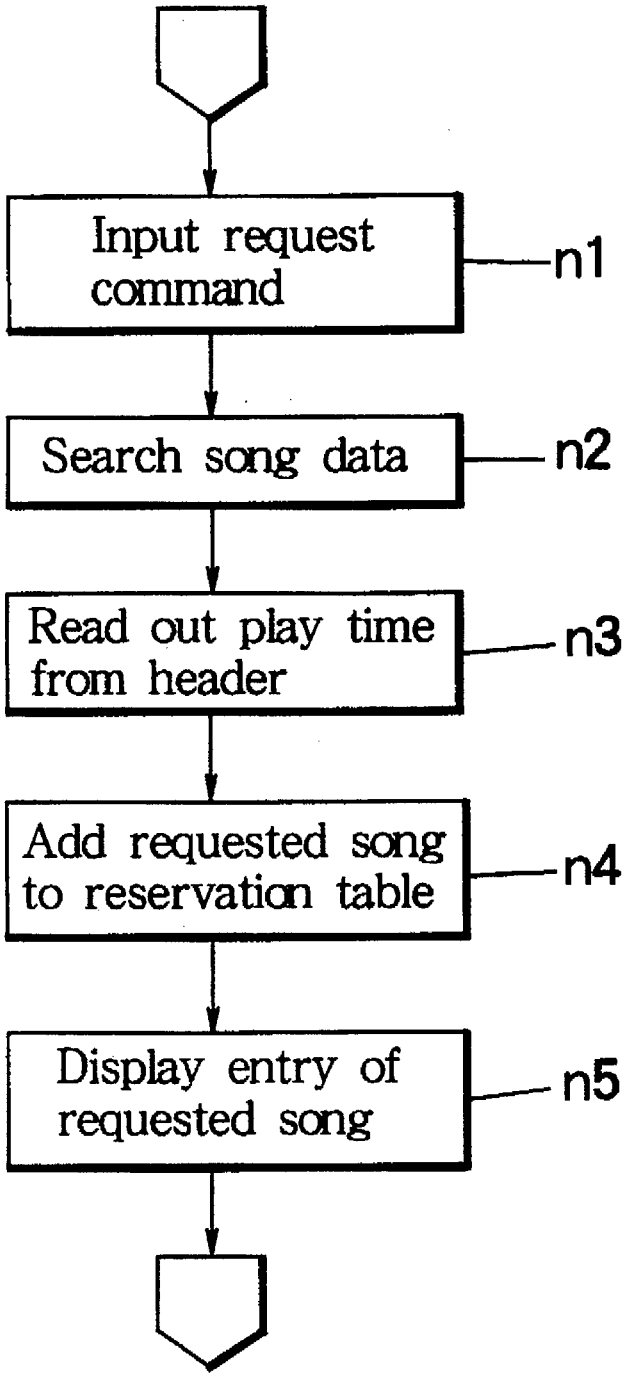
FIGS. 6–8 are flow charts showing operation of the inventive karaoke apparatus.
Figure 7:
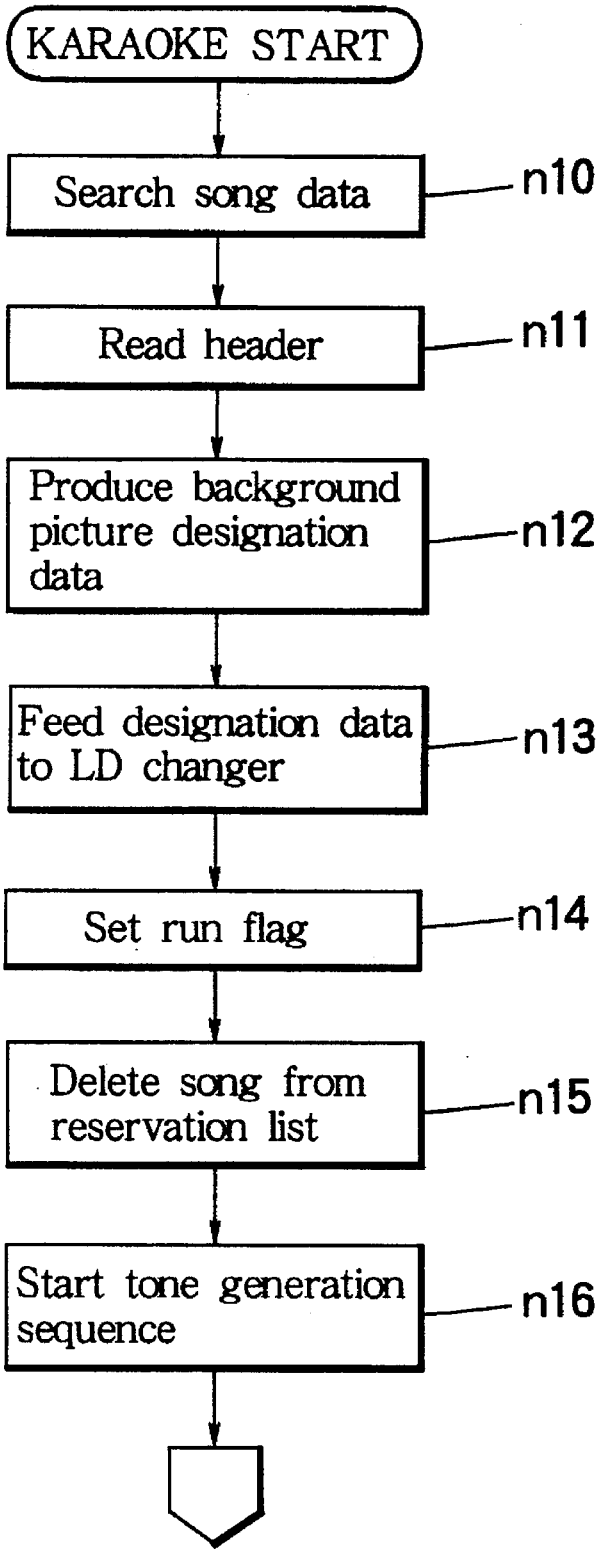
Figure 8:
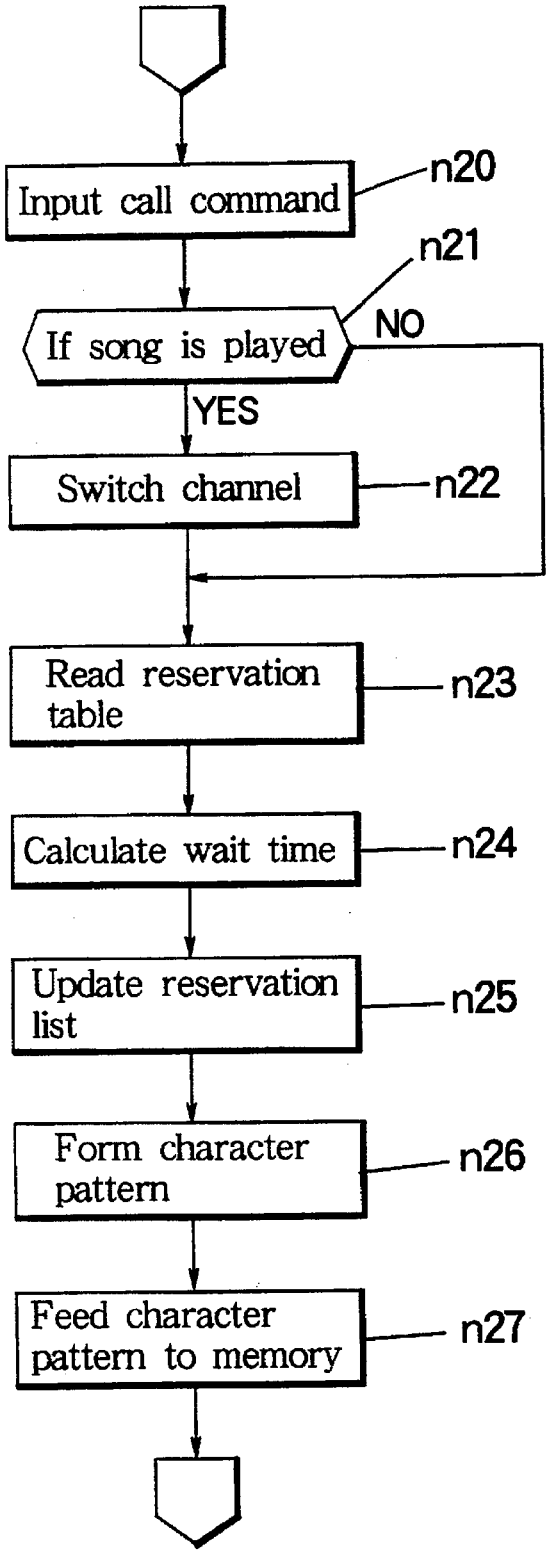

Next, detailed description is given for operation of the inventive karaoke apparatus with reference to FIGS. 6–8. FIG. 6 is a flow chart showing operation responsive to a request command. When a request command is inputted by means of the remote controller 30 or else in Step n1, the HDD 17 is searched in Step n2 to find song data of a karaoke song corresponding to a song code specified by the request command. Play time data is taken from a header of the searched song data in Step n3. The play time is written into the last row of the reservation table together with the song code in Step n4. Lastly, an entry message is displayed on the monitor in Step n5 to confirm the entry or reservation of the requested karaoke song. The entry message includes the song title and the wait time until the requested song is started. The wait time is calculated according to the following formula: (Sum of play times of all the reserved songs)+(a remaining time of the currently performed song)+(an interval time)×(number of the reserved songs).

FIG. 7 is a flow chart showing operation at start of karaoke play. The reservation table is searched to pick up a first song at top of the entry order in Step n10. Then, the header is retrieved from the composite song data of the first song in Step n11 to form the background picture designation data in Step n12. The background picture designation data is fed to the LD changer 30 in Step n13. A run flag is set at Step n14 to indicate that the sound source is turned from an inactive state to an active state. Then, the first song is erased from the reservation list, while advancing the second and further entry songs in Step n15. Concurrently, the song data of the addressed first song arc written into the play register. Thereafter, sequence operation is commenced to generate tones of the karaoke accompaniment of the addressed song in Step n16.

FIG. 8 is a flow chart showing operation commenced when the list call command is inputted. When the call command is inputted at Step n20, check is made in Step n21 according to the run flag as to if the karaoke song is currently played. If played, the select switch 36 is operated to select the second video signal at Step n22, thereby proceeding to Step n23. If not played, the routine directly advances to the Step n23 while the first video signal is continuously fed to both of the monitors 25 and 26. The registered data are read out from the reservation table at the Step n23 to update an old wait time of each reserved song at Step n24. The list shown in FIG. 5 is renewed according to the updated wait time at Step n25. The renewed list is converted into character pattern data at Step n26. The character pattern data are fed to the service message memory at Step n27. By such an operation, the reservation list is displayed on the audience monitor 25, and is concurrently displayed on the play monitor 26 unless the karaoke song is performed. Upon lapse of a predetermined time interval, the CPU 10 clears the service message memory 32, and returns the select switch 36 to the first channel if the same is previously turned to the second channel. Accordingly, the reservation list is displayed only on the audience monitor during the karaoke play. Otherwise, the reservation list, is displayed on all of the monitors during other than the karaoke play.

Further, when the karaoke play is incidentally commenced while the play monitor 26 displays the reservation list, the select switch 36 is automatically changed to select the second video signal to thereby exclude or delete the displayed reservation list from the play monitor 26. Moreover, in the disclosed embodiment, the select switch 36 is changed to the second video signal during the karaoke play in response to the manual input of the list call command. Alternatively, the select switch 36 may be automatically changed and fixed to the second channel during the karaoke play. Additionally, the service item is exemplified by the reservation list in this embodiment. However, the service information is not limited to the disclosed item, but may include various items which are not essential for the karaoke play but useful for management. In modification, another select switch may be provided for the audience monitor 25 to effect useful channel change such that the visual information displayed on the audience monitor 25 excludes an unnecessary item such as lyric words. In further modification, the karaoke apparatus may be provided with tempo adjustment function to adjust a tempo of the karaoke song. In such a case, the wait time of each reserved song is calculated whenever the tempo of the performed song is adjusted.

For summary, the inventive karaoke apparatus features that the video signal channels are selected independently among the plurality of the monitors. Therefore, the monitors can display different versions of the visual information. For example, the first channel provides the visual information containing the lyric words and service message, while the second channel provides the visual information including the lyric words but excluding the service message. During the play time of the karaoke song, the play monitor is connected to the second channel to thereby delete the unnecessary or unwanted service message which would obstruct or disturb the karaoke play. Namely, the channel selector comprises first means operative when the sound source is held in the inactive state for selecting the first video signal representative of visual information including a service item which is not essential to the karaoke play, and second means operative when the second source is switched to the active state for selecting the second video signal representative of visual information including a lyric item which is essential to the karaoke play, such that the play monitor displays the visual information including the necessary lyric item and excludes unnecessary service item under the active state of the sound source. Further, the first means comprises means for selecting a first video signal representative of visual information including a service it, era which prescribes an entry order of requested karaoke accompaniments. The inventive karaoke apparatus includes the additional audience monitor having a different purpose than the first-mentioned play monitor so that the channel selector selects different audio signals for the additional monitor and the first-mentioned monitor independently from each other according to the different purposes thereof. In such a case, the channel selector comprises first means for selecting a first video signal representative of visual information including a service item which is unnecessary for a player member who sings a song along the karaoke accompaniment but is necessary for audience members other than the player member so that the first video signal is fed to the additional monitor placed before the audience members, and second means for selecting a second video signal representative of visual information including a lyric item which is necessary for the player member so that the second video signal is fed to the first-mentioned monitor placed before the player member.

As described above, according to the invention, a plurality of video signal channels are provided to display different versions of the visual information. The video signal channels are switched to effect smooth change of the display screen in matching with a working state of the karaoke apparatus. Further, the channels are switched independently or separately for a plurality of monitors having different purposes. Therefore, for example, the lyric word message and the service message are separately or selectively applied to either of the play monitor and the audience monitor.

What is claimed is:

1. A karaoke apparatus for sounding a karaoke accompaniment and displaying visual images of a karaoke performance, the karaoke apparatus comprising:

an audio generating device responsive to a request for generating an audio signal;

a sound device switchable from an inactive state to an active state for receiving the audio signal to provide a karaoke accompaniment corresponding to the request;

a video gathering device having a plurality of channels for generating a plurality of video signals, each of the video signals representing visual information to be transmitted through a corresponding channel, the visual information including at least a plurality of service items and a plurality of lyric items for the karaoke performance;

a channel selector device for selecting one of the plurality of channels; and a monitor receptive of the selected channel for displaying images based upon the visual information corresponding to the selected channel such that, while the sound device is in the active state, the displayed image is based upon at least one of the lyric items exclusive of at least one of the service items, wherein the channel selector device includes a first section operative when the sound device is in the inactive state for selecting a first video signal representative of visual information including the at least one service item and a second section operative when the sound device is in the active state for selecting a second video signal representative of visual information including the at least one lyric item exclusive of the at least one service item, whereby the monitor displays the visual information including a necessary lyric item and excludes an unnecessary service item under the active state of the sound device.

2. A karaoke apparatus for sounding a karaoke accompaniment and displaying visual images in a karaoke performance, the karaoke apparatus comprising:

an audio generating device responsive to a request for generating an audio signal;

a sound device switchable from an inactive state to an active state for receiving the audio signal to provide a karaoke accompaniment corresponding to the request;

a video generating device having a plurality of channels for generating a plurality of video signals, each of the video signals representing visual information to be transmitted through a corresponding channel, the visual information including at least a plurality of service items and a plurality of lyric items for the karaoke performance;

a channel selector device for selecting one of the plurality of channels; and a monitor receptive of the selected channel for displaying images based upon the visual information corresponding to the selected channel such that, while the sound device is in the active state, the displayed image is based upon at least one of the lyric items exclusive of at least one of the service items, wherein the channel selector device includes a first section operative when the sound device is in the inactive state for selecting a first video signal representative of visual information including the at least one service item and a second section operative when the sound device is in the active state for selecting a second video signal representative of visual information including the at least one lyric item exclusive of the at least one service item, and wherein the first section comprises logic for selecting the first video signal representative of visual information including the at least one service item, the at least one service item prescribing an entry order of requested karaoke accompaniments, whereby the monitor displays the visual information including a necessary lyric item and excludes an unnecessary service item under the active state of the sound device.

3. A karaoke apparatus for sounding a karaoke accompaniment and displaying visual images in a karaoke performance, the karaoke apparatus comprising:

an audio generating device responsive to a request for generating an audio signal;

a sound device switchable from an inactive state to an active state for receiving the audio signal to provide a karaoke accompaniment corresponding to the request;

a video generating device having a plurality of channels for generating a plurality of video signals, each of the video signals representing visual information to be transmitted through a corresponding channel, the visual information corresponding to each channel having a plurality of items;

a channel selector device for selecting one of the plurality of channels;

a first monitor having a first purpose and being receptive of the selected channel for displaying images based upon the visual information corresponding to the selected channel such that, while the sound device is in an active state, the displayed image is based upon at least one necessary item exclusive of at least one unnecessary item; and a second monitor having a second purpose different from the first purpose of the first monitor, wherein the channel selector device further includes logic for independently selecting different audio signals for the first monitor and the second monitor according to the respective first and second purposes of the first and second monitors.

4. A karaoke apparatus according to claim 3, wherein the first monitor is viewable by a performance member and the second monitor is viewable by audience members, and the channel selector device further comprises:

logic for selecting a first video signal representative of visual information including a service item such that the first video signal is fed to the second monitor; and logic for selecting a second video signal representative of visual information including a lyric item such that the second video signal is fed to the first monitor.

5. A karaoke apparatus for sounding a karaoke accompaniment and displaying visual images in a karaoke performance, the karaoke apparatus comprising:

an audio generating device responsive to a request for generating an audio signal;

a sound device switchable from an inactive state to an active state for receiving the audio signal to provide a karaoke accompaniment corresponding to the request;

a video generating device having a plurality of channels for generating a plurality of video signals, each of the video signals representing visual information to be transmitted through a corresponding channel, the visual information corresponding to each channel having a plurality of items;

a channel selector device for selecting one of the plurality of channels; and a first monitor having a first purpose and being receptive of the selected channel for displaying images based upon the visual information corresponding to the selected channel such that, while the sound device in the active state, the displayed image is based upon at least a necessary item exclusive of at least one unnecessary item, wherein the channel selector device is connectable to a second monitor having a second purpose different from the first purpose of the first monitor, and wherein the channel selector device further includes logic for independently selecting different audio signals for the first monitor and the second monitor according to the respective first and second purposes of the first and second monitors.

* * * * *